US006583105B1

(12) United States Patent
Höhener et al.

(10) Patent No.: US 6,583,105 B1
(45) Date of Patent: Jun. 24, 2003

(54) FABRIC SOFTENER COMPOSITION

(75) Inventors: Alfred Höhener, Magden (CH); Roland Frick, Durmenach (FR)

(73) Assignee: Ciba Specialty Chemical Corporation, Tarrytown, NY (US)

( * ) Notice: Subject to any disclaimer, the term of this patent is extended or adjusted under 35 U.S.C. 154(b) by 204 days.

(21) Appl. No.: 09/618,870

(22) Filed: Jul. 19, 2000

Related U.S. Application Data

(63) Continuation of application No. 09/134,552, filed on Aug. 14, 1998, now abandoned.

(30) Foreign Application Priority Data

Aug. 15, 1997 (EP) ..... 97810573

(51) Int. Cl.[7] ..... C11D 3/395; C11D 1/62
(52) U.S. Cl. ..... 510/516; 510/301
(58) Field of Search ..... 510/301, 516

(56) References Cited

U.S. PATENT DOCUMENTS

| | | | | | |
|---|---|---|---|---|---|
| 3,927,967 | A | | 12/1975 | Speakman | 8/103 |
| 4,033,718 | A | * | 7/1977 | Holcombe et al. | 8/103 |
| 4,094,806 | A | | 6/1978 | Wiers | 252/102 |
| 4,166,718 | A | | 9/1979 | Reinert et al. | 8/111 |
| 4,240,920 | A | | 12/1980 | de Luque | 252/99 |
| 4,255,273 | A | | 3/1981 | Sakkab | 252/102 |
| 4,368,053 | A | | 1/1983 | Eckhardt et al. | 8/102 |
| 4,400,173 | A | * | 8/1983 | Beavan | 8/107 |
| 5,679,661 | A | * | 10/1997 | Willey | 514/63 |
| 5,744,435 | A | * | 4/1998 | Hartman et al. | 510/101 |
| 5,916,481 | A | * | 6/1999 | Willey | 252/186.21 |

FOREIGN PATENT DOCUMENTS

| | | | |
|---|---|---|---|
| EP | 003371 | | 8/1979 |
| EP | 3861 | * | 9/1979 |
| EP | 484027 | * | 12/1996 |
| JP | 4-108172 | | 4/1992 |
| JP | 7-82591 | | 3/1995 |
| WO | 96/21714 | | 7/1996 |
| WO | WO 96/21714 | * | 7/1996 |
| WO | 97/05202 | | 2/1997 |
| WO | 97/05203 | | 2/1997 |

* cited by examiner

*Primary Examiner*—John Hardee
(74) *Attorney, Agent, or Firm*—Kevin T. Mansfield

(57) ABSTRACT

The invention relates to a fabric softener composition comprising (a) a water-soluble phthalocyanine of Zn, Fe(II), Ca, Mg, Na, K, Al, Si(IV), P(V), Ti(IV), Ge(IV), Cr(VI), Ga(III), Zr(IV), In(III), Sn(IV) or Hf(VI); and (b) a quaternary ammonium compound of the formula (1)

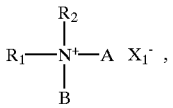

in which $R_1$ and $R_2$ independently of one another are $C_1$–$C_5$alkyl; or hydroxy-$C_1$–$C_5$alkyl;

A and B are a $C_8$–$C_{20}$ fatty acid radical; the radical of the formula (1a)

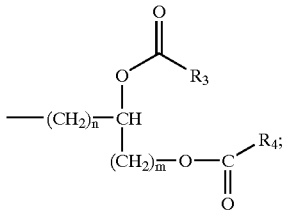

(1b)

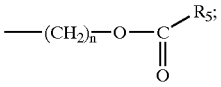

or the radical of the formula

B is $C_1$–$C_5$alkyl; a $C_8$–$C_{20}$ fatty acid radical; the radical of the formula (1*a*) or the radical of the formula (1*b*);

$R_3$, $R_4$ and $R_5$ independently of one another are a $C_8$–$C_{20}$ fatty acid radical;

$X_1^-$ is a softener-compatible anion; and m, n and p are numbers from 0 to 5.

The novel composition is used to obtain good bleaching effects on soiled textile fabrics.

15 Claims, No Drawings

FABRIC SOFTENER COMPOSITION

This is a continuation of application Ser. No. 09/134,552, filed on Aug. 14, 1998, now abandoned.

The present invention relates to a fabric softener composition and to a process for the bleaching of textile fibre materials using this fabric softener composition.

In customary household washing processes for whites, such as bed linen, table linen and white cotton fabrics, the laundry items to be treated are normally subjected to a combined washing and bleaching process in which the items of laundry are treated in an aqueous bath comprising, as active substance, an organic detergent and a bleach. Processes for bleaching or removing stains from textiles using water-soluble phthalocyanine compounds are known, for example, from U.S. Pat. Nos. 3,927,967, 4,094,806 and 4,033,718.

The object of the present invention is to use water-soluble phthalocyanine compounds as photobleaching agents in certain fabric softener compositions comprising, as active substance, ester quats, which are quaternary ammonium compounds having at least one long-chain hydrophobic alkyl or alkenyl group interrupted by carboxyl groups. Fabric softeners containing ester quats are described, for example, in EP-A-0 239 910 or WO 95/24460.

Surprisingly, it has now been found that fabric softener compositions comprising water-soluble phthalocyanine compounds of a cationic, neutral or anionic nature bring about particularly good bleaching effects if textiles are treated in an aqueous fabric softener bath comprising these compositions, the textiles being irradiated with light in the visible and/or infrared region or in the daylight in the fabric softener bath itself or subsequently in the damp state.

The present invention thus relates to a fabric softener composition comprising (a) a water-soluble phthalocyanine of Zn, Fe(II), Ca, Mg, Na, K, Al, Si(IV), P(V), Ti(IV), Ge(IV), Cr(VI), Ga(III), Zr(IV), In(III), Sn(IV) or Hf(VI); and (b) a quaternary ammonium compound of the formula (1)

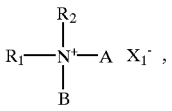

in which $R_1$ and $R_2$ independently of one another are $C_1$–$C_5$alkyl; or hydroxy-$C_1$–$C_5$alkyl;

A is the radical of the formula (1a)

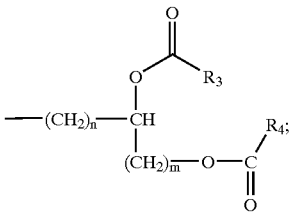

or the radical of the formula (1b)

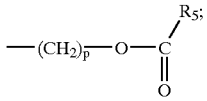

B is $C_1$–$C_5$alkyl; a $C_8$–$C_{20}$ fatty acid radical; the radical of the formula (1a) or the, radical of the formula (1b);

$R_3$, $R_4$ and $R_5$ independently of one another are a $C_8$–$C_{20}$ fatty acid radical;

$X_1^-$ is a softener-compatible anion; and m, n and p are numbers from 0 to 5.

The novel composition advantageously comprises, as photobleaching agent, a compound of the formula (2a)

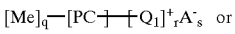

or (2b)

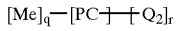

in which

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, carboxylate, alkanolate, or hydroxyl ion;

q is 0, 1 or 2;

r is 1 to 4;

$Q_1$ is a sulfo or carboxyl group; or a radical of the formula $$—SO_2X_2—R_6—X_3^+,\ —O—R_6—X_3^+;\ \text{or}\ —(CH_2)_t—Y_1^+;$$

in which $R_6$ is a branched or unbranched $C_1$–$C_8$alkylene; or 1,3- or 1,4-phenylene;

$X_2$ is —NH—; or —N—$C_1$–$C_5$alkyl;

$X_3^+$ is a group of the formula

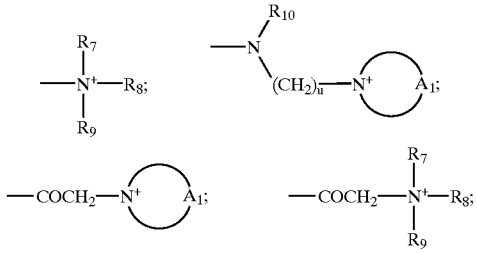

or, in the case where $R_6$=$C_1$–$C_8$alkylene, also a group of the formula

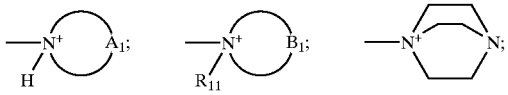

-continued

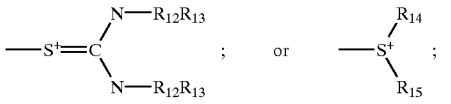

$Y_1^+$ is a group of the formula

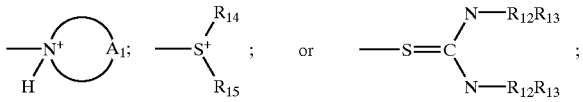

t is 0 or 1;

where in the above formulae $R_7$ and $R_8$ independently of one another are $C_1$–$C_6$alkyl;

$R_9$ is $C_1$–$C_6$alkyl; $C_5$–$C_7$cycloalkyl; or $NR_{11}R_{12}$;

$R_{10}$ and $R_{11}$ independently of one another are $C_1$–$C_5$alkyl;

$R_{12}$ and $R_{13}$ independently of one another are hydrogen or $C_1$–$C_5$alkyl;

$R_{14}$ and $R_{15}$ independently of one another are unsubstituted $C_1$–$C_6$alkyl or $C_1$–$C_6$alkyl substituted by hydroxyl, cyano, carboxyl, carb-$C_1$–$C_6$alkoxy, $C_1$–$C_6$alkoxy, phenyl, naphthyl or pyridyl;

u is from 1 to 6;

$A_1$ is a unit which completes an aromatic 5- to 7-membered nitrogen heterocycle, which may where appropriate also contain one or two further nitrogen atoms as ring members, and $B_1$ is a unit which completes a saturated 5- to 7-membered nitrogen heterocycle, which may where appropriate also contain 1 to 2 nitrogen, oxygen and/or sulfur atoms as ring members;

$Q_2$ is hydroxyl; $C_1$–$C_{22}$alkyl; branched $C_4$–$C_{22}$alkyl; $C_2$–$C_{22}$alkenyl; branched $C_4$–$C_{22}$alkenyl and mixtures thereof; $C_1$–$C_{22}$alkoxy; a sulfo or carboxyl radical; a radical of the formula

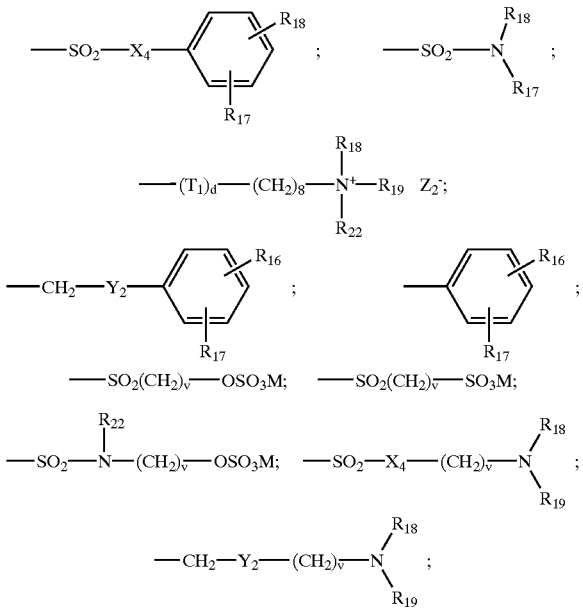

-continued

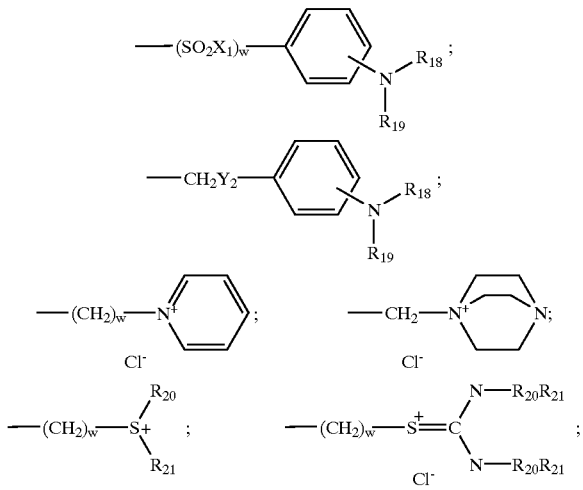

a branched alkoxy radical of the formula

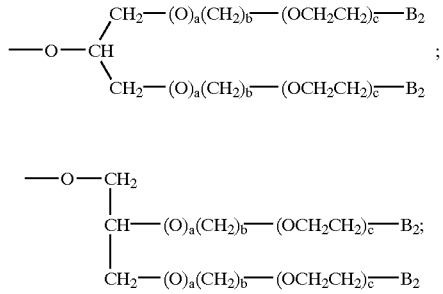

an alkylethyleneoxy unit of the formula $—(T_1)_d—(CH_2)_b(OCH_2CH_2)_a—B_3$ or an ester of the formula $COOR_{23}$ in which $B_2$ is hydrogen; hydroxyl; $C_1$–$C_{30}$alkyl; $C_1$–$C_{30}$alkoxy; $—CO_2H$; $—CH_2COOH$; $SO_3^-M_1^+$; $—OSO_3^-M_1^+$; $—PO_3^{2-}M_1$; $—OPO_3^{2-}M_1$; and mixtures thereof;

$B_3$ is hydrogen; hydroxyl; —COOH; $—SO_3^-M_1^+$; $—OSO_3^-M_1^+$; $C_1$–$C_6$alkoxy;

$M_1$ is a water-soluble cation;

$T_1$ is —O—; or —NH—;

$X_1$ and $X_4$ independently of one another are —O—; —NH—; or —N—$C_1$–$C_5$alkyl;

$R_{16}$ and $R_{17}$ independently of one another are hydrogen, a sulfo group and salts thereof, a carboxyl group and salts thereof or a hydroxyl group, at least one of the radicals $R_{16}$ and $R_{17}$ being a sulfo or carboxyl group or salts thereof, $Y_2$ is —O—, —S—, —NH—or —N—$C_1$–$C_5$alkyl;

$R_{18}$ and $R_{19}$ independently of one another are hydrogen, $C_1$–$C_6$alkyl, hydroxy-$C_1$–$C_6$alkyl, cyano-$C_1$–$C_6$alkyl, sulfo-$C_1$–$C_6$alkyl, carboxy or halogen-$C_1$–$C_6$alkyl; unsubstituted phenyl or phenyl substituted by halogen, $C_1$–$C_4$alkyl or $C_1$–$C_4$alkoxy, sulfo or carboxyl or $R_{18}$ and $R_{19}$ together with the nitrogen atom to which they are bonded are a saturated 5- or 6-membered heterocyclic ring which may additionally also contain a nitrogen or oxygen atom as a ring member;

$R_{20}$ and $R_{21}$ independently of one another are $C_1$–$C_6$alkyl or aryl-$C_1$–$C_6$alkyl radicals;

$R_{22}$ is hydrogen; an unsubstituted $C_1$–$C_6$alkyl or $C_1$–$C_6$alkyl substituted by halogen, hydroxyl, cyano, phenyl, carboxyl, carb-$C_1$–$C_6$alkoxy or $C_1$–$C_6$alkoxy;

$R_{23}$ is $C_1$–$C_{22}$alkyl, branched $C_4$–$C_{22}$alkyl, $C_1$–$C_{22}$alkenyl or branched $C_4$–$C_{22}$alkenyl; $C_3$–$C_{22}$glycol; $C_1$–$C_{22}$alkoxy; branched $C_4$–$C_{22}$alkoxy; and mixtures thereof;

M is hydrogen; or an alkali metal ion or ammonium ion, $Z_2$ is a chlorine, bromine, alkylsulfate or aralkylsulfate ion;

a is 0 or 1;

b is from 0 to 6;

c is from 0 to 100;

d is 0; or 1;

e is from 0 to 22;

v is an integer from 2 to 12;

w is 0 or 1; and

A is an organic or inorganic anion, and s is equal to r in cases of monovalent anions $A^-$ and is $\leqq$r in cases of polyvalent anions, it being necessary for $A_s^-$ to compensate the positive charge; where, when r≠1, the radicals $Q_1$ can be identical or different, and where the phthalocyanine ring system may also comprise further solublising groups.

The number of substituents $Q_1$ and $Q_2$ in the formula (2a) and (2b) respectively, which may be identical or different, is between 1 and 8, and it is not imperative, as is generally the case with phthalocyanines, for it to be an integer (degree of substitution). If other noncationic substituents are present, the sum of the latter and the cationic substituents is between 1 and 4. The minimum number of substituents which must be present in the molecule is governed by the solubility of the resulting molecule in water. It is sufficiently soluble in water when enough of the phthalocyanine compound dissolves to effect a photodynamically catalysed oxidation on the fibre. A solubility as low as 0.01 mg/l may suffice, although one of from 0.001 to 1 g/l is generally advantageous.

Halogen means fluorine, bromine or, in particular, chlorine.

Especially suitable groups

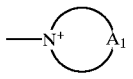

are:

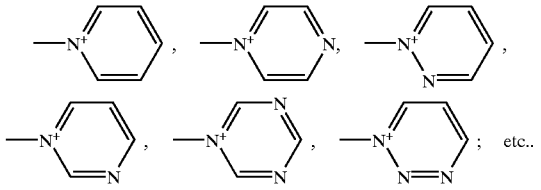

Preference is given to the group

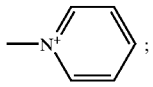

Suitable heterocyclic rings in the group

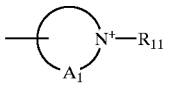

are likewise the groups listed above, the bond to the other substituents merely being via a carbon atom.

In all of these substituents, phenyl, naphthyl and aromatic hetero rings may be substituted by one or two further radicals, for example by $C_1$–$C_6$alkyl, $C_1$–$C_6$alkoxy, halogen, carboxyl, carb-$C_1$–$C_6$alkoxy, hydroxyl, amino, cyano, sulfo, sulfonamido, etc.

Preference is given to a substituent from the group $C_1$–$C_6$alkyl, $C_1$–$C_6$alkoxy, halogen, carboxyl, carb-$C_1$–$C_6$alkoxy or hydroxyl.

Particularly suitable groups

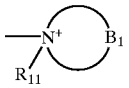

are:

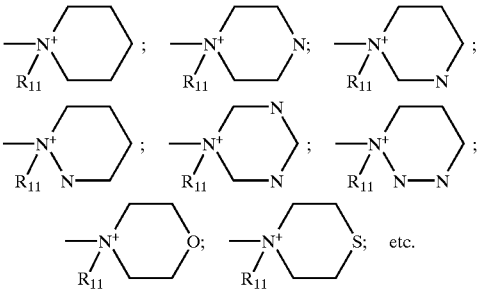

All of the aforementioned nitrogen heterocycles can also be substituted by alkyl groups, either on a carbon atom or on another nitrogen atom in the ring. The alkyl group is preferably the methyl group.

$A^-_s$ in formula (2a) is, as a counterion to the positive charge on the remainder of the molecule, any anion. In general, it is introduced by the preparation process (quaternization). It is then preferably a halogen ion, an alkylsulfate or an arylsulfate ion. Arylsulfate ions which may be mentioned are the phenylsulfonate, p-tolylsulfonate and the p-chlorophenylsulfonate ion. The anion can however also be any other anion since the anions can be readily exchanged in a known manner; $A_s^-$ can thus also be a sulfate, sulfite, carbonate, phosphate, nitrate, acetate, oxalate, citrate, lactate ion or another anion of an organic carboxylic add. The index s is the same as r for monovalent anions. For polyvalent anions, s has a value $\leqq$r, in which case it must be chosen, depending on the conditions, such that it exactly balances the positive charge on the remainder of the molecule.

$C_1$–$C_6$alkyl and $C_1$–$C_6$alkoxy are straight-chain or branched alkyl or alkoxy radicals, such as, for example, methyl, ethyl, n-propyl, isopropyl, n-butyl, sec-butyl, tert-butyl, amyl, isoamyl, tert-amyl or hexyl or methoxy, ethoxy, n-propoxy, isopropoxy, n-butoxy, sec-butoxy, tert-butoxy, amyloxy, isoamyloxy, tert-amyloxy or hexyloxy.

$C_2$–$C_{22}$alkenyl is, for example, allyl, methallyl, isopropenyl, 2-butenyl, 3-butenyl, isobutenyl, n-penta-2,4-dienyl, 3-methyl-but-2-enyl, n-oct-2-enyl, n-dodec-2-enyl, iso-dodecenyl, n-dodec-2-enyl or n-octadec-4-enyl.

The $C_8$–$C_{20}$ fatty acid radicals defined for the quaternary ammonium compounds of the formula (1) are derived from saturated or unsaturated fatty acids, such as, for example, from capric, lauric, myristic, palmitic, stearic, dodecyl; pentadecyl; hexadecyl or oleyl acid; or decanoic, dodecanoic, tetradecanoic, hexadecanoic, oleic, linoleic, linolenic, ricinoleic acid, coconut fatty acid, or preferably tallow fatty acid.

Preferred photobleaching agents of the formula (2a) of the novel composition have the formula (3a)

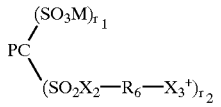

in which

PC, $X_2$, $X_3$, and $R_6$ are as defined above;

M is hydrogen, an alkali metal ion, ammonium ion or amine salt ion; and the sum of the numbers $r_1$ and $r_2$ is from 1 to 4 and $A_s$ balances exactly the positive charge on the remainder of the molecule, and in particular the formula (4)

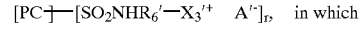

in which

PC is as defined in formula (2a), $R_6'$ is $C_2$–$C_6$alkylene;

$r_1$ is a number from 1 to 4;

$X_3'$ is a group of the formula

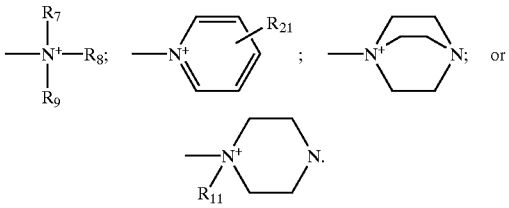

in which $R_7$ and $R_8$ independently of one another are unsubstituted $C_1$–$C_4$alkyl or $C_1$–$C_4$alkyl substituted by hydroxyl, cyano, halogen or phenyl;

$R_9$ is $R_7$; cyclohexyl or amino;

$R_{11}$ is $C_1$–$C_4$alkyl;

$R_{21}$ is $C_1$–$C_4$alkyl; $C_1$–$C_4$alkoxy; halogen, carboxyl, carb-$C_1$–$C_4$alkoxy or hydroxyl; and A" is a halide, alkylsulfate or arylsulfate ion;

it being possible for the radicals $—SO_2NHR'_6—X_3'^{+}A^-$ to be identical or different.

Other photobleaching agents which can be used according to the invention have the formula (5)

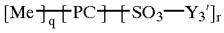

in which

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, carboxylate, alkanolate, or hydroxyl ion;

q is 0; 1; or 2;

$Y_3'$ is hydrogen, an alkali metal ion or ammonium ion; and r is any number from 1 to 4.

Very particularly preferred phthalocyanine compounds have the formula (5), in which Me is Zn or Al—$Z_1$; and $Z_1$ is a halide, sulfate, nitrate, carboxylate, alkanolate, or hydroxyl ion.

Other interesting phthalocyanine compounds which can be used according to the invention have the formula (6)

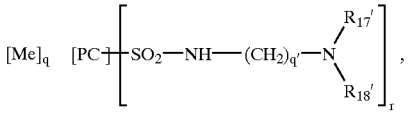

in which

PC, Me and q are as defined in formula (5);

$R_{17}'$ and $R_{18}'$ independently of one another are hydrogen, phenyl, sulfophenyl, carboxyphenyl, $C_1$–$C_6$alkyl, hydroxy-$C_1$–$C_6$alkyl, cyano-$C_1$–$C_6$alkyl, sulfo-$C_1$–$C_6$alkyl, carboxy-$C_1$–$C_6$alkyl or halogen-$C_1$–$C_6$alkyl or together with the nitrogen atom form the morpholine ring;

q' is an integer from 2 to 6; and r is a number from 1 to 4;

where, if r is >1, the radicals

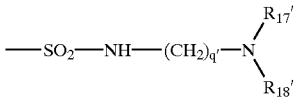

present in the molecule may be identical or different.

Further interesting phthalocyanine compounds which can be used according to the invention have the formula (7)

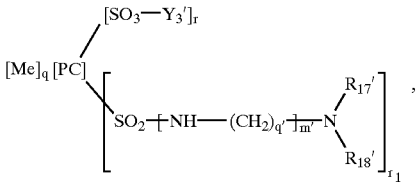

in which

PC, Me and q are as defined in formula (5), $Y'_3$ is hydrogen, an alkali metal ion or ammonium ion, q' is an integer from 2 to 6;

$R_{17}'$ and $R_{18}'$ independently of one another are hydrogen, phenyl, sulfophenyl, carboxyphenyl, $C_1$–$C_6$alkyl, hydroxy-$C_1$–$C_6$alkyl, cyano-$C_1$–$C_6$alkyl, sulfo-$C_1$–$C_6$alkyl, carboxy-$C_1$–$C_6$alkyl or halogen-$C_1$–$C_6$alkyl or together with the nitrogen atom form the morpholine ring;

m' is 0 or 1; and r and $r_1$ independently of one another are any number from 0.5 to 3, the sum $r+r_1$ being at least 1, but no more than 4.

If the central atom Me in the phthalocyanine ring is Si(IV), the phthalocyanines used according to the invention may also have axial substituents (=$R_{24}$) in addition to the substituents on the phenyl ring of the phthalocyanine ring. Such phthalocyanines have, for example, the formula (10)

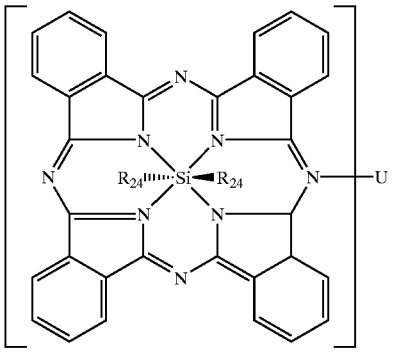

in which $R_{24}$ is hydroxyl; $C_1$–$C_{22}$alkyl; branched $C_4$–$C_{22}$alkyl; $C_1$–$C_{22}$alkenyl; branched $C_4$–$C_{22}$alkenyl and mixtures thereof; $C_1$–$C_{22}$alkoxy; a sulfo or carboxyl radical; a radical of the formula

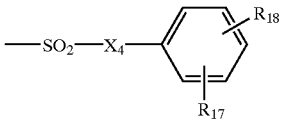

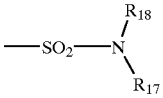

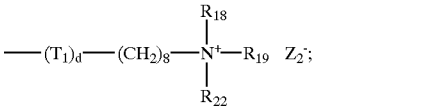

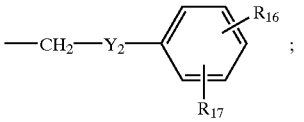

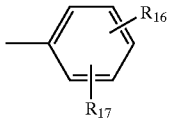

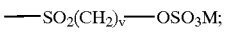

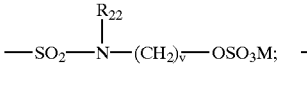

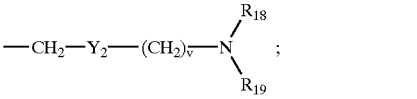

-continued

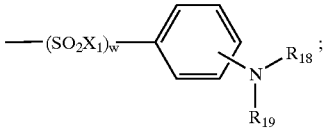

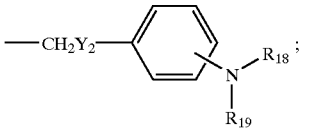

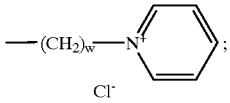

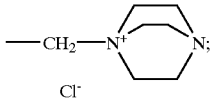

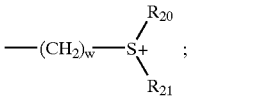

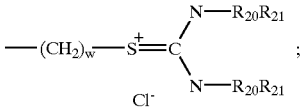

a branched alkoxy radical of the formula

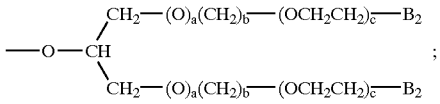

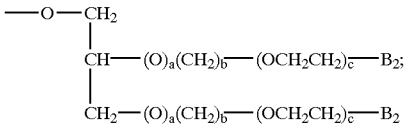

an alkylethyleneoxy unit of the formula —$(T_1)_d$—$(CH_2)_b(OCH_2CH_2)_a$—$B_3$ or an ester of the formula $COOR_{23}$; and U is $[Q_1]_r^+A_s^-$; or $Q_2$.

$R_{16}$, $R_{17}$, $R_{18}$, $R_{19}$, $R_{20}$, $R_{21}$, $R_{22}$, $R_{23}$, $B_2$, $B_3$, M, $M_1$, $Q_1$, $Q_2$, $A_s$, $T_1$, $X_1$, $Y_2$, $Z_2$, a, b, c, d, e, r, v, w are as defined in the formulae (2a) and (2b).

Quaternary ammonium compounds of the component (b) preferably used according to the invention are compounds of the formula (1) in which $X_1$ is a halogen atom; —$CH_3SO_4^-$; —$C_2H_5SO_4^-$; or —$NO_3^-$.

Quaternary ammonium compounds which are particularly preferably used according to the invention are those of the formula (1) in which A and B independently of one another are the radical of the formula (1a) or (1b), or those compounds of the formula (1) in which A and B are the radical of the formula (1b).

Very particularly preferred quaternary ammonium compounds have the formula (8)

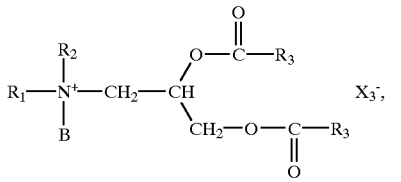

in which $R_1$, $R_2$ and B are $C_1$–$C_5$alkyl;

$R_3$ is the aliphatic radical of tallow fatty acid; and $X_3^-$ is a halogen atom.

Further interesting quaternary ammonium compounds have the formula (9)

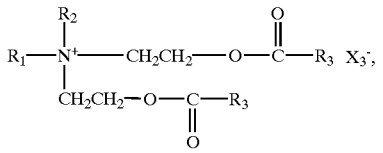

in which $R_1$ and $R_2$ are $C_1$–$C_5$alkyl;

$R_3$ is the aliphatic radical of tallow fatty acid and $X_3^-$ is a halogen atom.

Preference is given to using fabric softener compositions comprising (a) a water-soluble phthalocyanine of the formula (5); and (b) a quaternary ammonium compound of the formula (8).

Preference is also given to using fabric softener compositions comprising (a) a water-soluble phthalocyanine of the formula (10) and (b) a quaternary ammonium compound of the formula (8).

The photobleaching agents used according to the invention are used in the fabric softener composition only in small amounts and thus have a catalytic effect.

The novel fabric softener compositions preferably comprise from 0.0001 to 0.05% by weight, preferably from 0.001 to 0.005% by weight, of component (a) and from 1 to 20% by weight, preferably from 5 to 20% by weight, of component (b).

The novel fabric softener composition may also comprise additives customary for standard commercial fabric softeners, such as alcohols, such as, for example, ethanol, n-propanol, i-propanol, polyhydric alcohols, such as, for example, glycerol and propylene glycol; amphoteric and nonionic surfactants, such as, for example, carboxyl derivatives of imidazole, oxethylated fatty alcohols, hydrogenated and ethoxylated castor oil, alkyl polyglycosides, for example decylpolyglucose and dodecylpolyglucose, fatty alcohols, fatty acid esters, fatty acids, ethoxylated fatty acid glycerides or fatty acid partial glycerides; also relatively small amounts of dyes, perfumes, buffer substances, inorganic or organic salts, such as, for example, water-soluble potassium, sodium or magnesium salts, non-aqueous solvents, pH buffers, hydrotropic agents, antifoams, corrosion inhibitors, antiredeposition agents, viscosity regulators, in particular polymeric or other thickeners, stabilisers, enzymes, optical brighteners, antishrink agents, stain removers, antimicrobial agents, germicides, fungicides, antioxidants, and anticrease agents.

The novel fabric softener composition is usually liquid. The active ingredients present therein are preferably emulsified in water. Preparation usually involves firstly stirring the active substance, i.e. the quaternary ammonium compound of the formula (1) in the molten state into water, then, where required, adding further desired additives and, finally, after cooling, adding the phthalocyanine compound as a diluted stock solution.

Another subject-matter of the invention is a process for the bleaching of textiles using a photobleaching agent, which comprises treating soiled textiles in a bath of a fabric softener composition comprising (a) a water-soluble phthalocyanine of Zn, Fe(II), Ca, Mg, Na, K, Al, Si(IV), P(V), Ti(IV), Ge(IV), Cr(VI), Ga(III), Zr(IV), Sn(III), Sn(IV) or Hf(VI) phthalocyanine; and (b) a quaternary ammonium compound of the formula (1), with irradiation with visible and/or infrared light or daylight, either on the fabric softener bath directly or on the damp textiles outside the fabric softener bath, and in the presence of oxygen.

The novel composition is used in the manner customary for known fabric softeners, the photobleaching agent only becoming effective upon irradiation with light, as described, for example, in U.S. Pat. No. 4,166,718. For example, textiles washed in a customary washing cycle are post-treated in a liquor comprising a novel fabric softener composition in a rinsing operation. Irradiation with visible and/or infrared light can be carried out directly in the fabric softener liquor, for example using a suitable artificial light source in the washing machine. Irradiation can, however, also be preferably carried out after the textiles have been removed from the rinsing bath in the damp state, the light source used preferably being sunlight. In this case, exposure can suitably be carried out while the textiles are drying. If the textiles are not dried on a line, but, for example, in a tumbledryer, exposure may also take place during this drying process, for example using a suitable artificial light source, fixed to or in the tumbledryer. For the photobleaching agent to be effective, the presence of oxygen is also required. The oxygen present (dissolved) in the wash liquor (the liquor should as far as possible contain no reducing agent) or the (dissolved) oxygen which is present in the liquor or atmospheric oxygen when exposure takes place outside the bath is sufficient.

Examples of suitable textile fibre materials which may be treated with the novel fabric softener composition are materials made of silk, wool, polyamide or polyurethanes, and in particular cellulosic fibre materials of all types. Examples of such fibre materials are the natural cellulose fibres, such as cotton, linen, jute and hemp, and also pulp and regenerated cellulose. Preference is given to textile fibre materials made of cotton. The novel fabric softener compositions are also suitable for hydroxyl group-containing fibres which are present in mixed fibres, for example mixtures of cotton with polyester fibres or polyamide fibres.

The effect of the photobleaching agent considerably improves removal of stains from the treated fabric. In addition, colour transfer between individual fabric articles can be prevented or reduced.

Furthermore, the novel composition has the advantage that the effect of the essential components is not mutually influenced, so that the bleaching effect of the photobleaching agent is not impaired by the quaternary ammonium compound and vice versa.

The examples below serve to illustrate the invention without limiting it thereto.

EXAMPLES 1 TO 4

Preparation of the Fabric Softener Formulations

TABLE 1

| Example | Concentration of the formulation (102) [%] | Amount of the formulation (102) used [g] | amount of water used [g] | Amount of compound of the formula (102) [mg] | Compound of the formula (102) based on fabric softener formulation [%] |
|---|---|---|---|---|---|
| 1 | 0 | 0.0 | 0.9 | 0.0 | 0.0 |
| 2 | 0.0038 | 0.9 | 0.0 | 0.345 | 0.00115 |
| 3 | 0.23 | 0.45 | 0.45 | 1.035 | 0.00345 |
| 4 | 0.23 | 0.9 | 0.0 | 2.074 | 0.00690 |

29.1 g of a fabric softener comprising, as active substance 4.5 g (15% with respect to the fabric softener formulation), of the compound of the formula

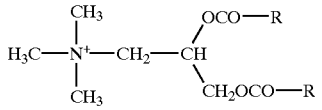

(101)

R = tallow fatty acid radical are introduced initially into a 50 ml bottle. 0.9 g of water or a mixture of water and the given amount of the formulation comprising as active substance a compound of the formula $$AlClPC(SO_3H)_{3-4} \quad (102)$$

are added thereto. The bottle is then screwed tightly shut and vigorously shaken several times.

A viscous homogeneous liquid is formed.

EXAMPLE 5 a) A 250 g cotton fabric soiled with red wine and 750 g of bleached cotton fabric used as ballast are washed at 30° C. in 10 l of water using a commercially available detergent in a washing machine for 15 minutes.

After the washing operation, the washed cotton fabric is rinsed under running water.

b) A second rinsing operation is carried out using the formulations from Examples 1 to 4. For this purpose, the two laundry articles washed and rinsed under a) are washed with 6 l of water and 30 g of each of the formulations from Examples 1 to 4 for 5 minutes at 30° C. in a washing machine. The items of laundry are then spun dry.

1 part of the items of laundry treated in this way is subsequently ironed dry, and the other part is exposed in the damp state under Osram lamps for 2 hours and subsequently ironed dry.

The degree of bleaching of the test fabric is then measured using a photometer in the form of brightness values (=Y), expressed in %, based on the absolute whiteness in accordance with the CIE recommendation of 1.1.1969. The results obtained are summarised in Table 2.

TABLE 2

| Formulation from | without exposure | | with exposure for 2 hours | |
|---|---|---|---|---|
| Example | Y [%] | ΔY | Y [%] | ΔY |
| 1 | 68.1 | | 71.1 | |
| 2 | 67.9 | −0.2 | 74 | 2.9 |
| 3 | 67.3 | −0.8 | 75.9 | 4.8 |
| 4 | 67.6 | −0.5 | 77.8 | 6.7 |

The results show that significantly higher brightness values are achieved using the novel fabric softener composition after exposure for two hours.

EXAMPLE 6

The procedure is as described in Example 5, with the difference that cotton with tea is used.

The results are given in Table 3:

TABLE 3

| Formulation from | without exposure | | with exposure for 2 hours | |
|---|---|---|---|---|
| Example | Y [%] | ΔY | Y [%] | ΔY |
| 1 | 58.1 | | 59.1 | |
| 2 | 58.2 | 0.1 | 60.5 | 1.4 |
| 3 | 58 | −0.1 | 61.2 | 2.1 |
| 4 | 57.9 | −0.2 | 63.3 | 4.2 |

The results show that significantly higher brightness values are achieved using the novel fabric softener composition after exposure for two hours.

EXAMPLE 7

The procedure is as described in Example 5, with the difference that cotton fabric soiled with coffee is used.

The results are given in Table 4:

TABLE 4

| Formulation from | without exposure | | with exposure for 2 hours | | with exposure for 4 hours | |
|---|---|---|---|---|---|---|
| Example | Y [%] | ΔY | Y [%] | ΔY | Y [%] | ΔY |
| 1 | 79.4 | | 81.2 | | 83.4 | |
| 2 | 78.6 | −0.8 | 84.5 | 3.3 | 87 | 3.6 |
| 3 | 78.6 | −0.8 | 86.3 | 5.1 | 88.7 | 5.3 |
| 4 | 78.7 | −0.7 | 86.5 | 5.3 | 89 | 5.6 |

The results show that significantly higher brightness values are achieved using the novel fabric softener composition after exposure for 2 and 4 hours.

EXAMPLE 8

Preparation of a Fabric Softener Formulation 7.5 g of the compound of the formula (103)

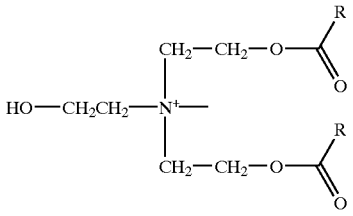

R = tallow fatty acid radical are diluted with water to 40 g and stirred at 50–60° C. in a water bath to give a homogeneous paste, giving a 18.75% strength aqueous formulation of the compound of the formula (103) (=formulation 8a).

0.15 g of a 2% strength solution of the compound of the formula (102) and 1.85 g of water are added to 8.0 g of this paste, and the whole mixture is stirred at 50–60° C. in a water bath to give a homogeneous paste.

The resulting fabric softener formulation comprises

15% of the compound of the formula (103) and 0.00345% of the compound of the formula (102) (=formulation 8b).

EXAMPLE 9

Washing Test a. Washing with Test Detergent 1 kg of fabric, consisting of 250 g of cotton fabric soiled with red wine, coffee and tea, and 750 g of bleached cotton fabric as ballast are washed with 10 litres of water and 40 g of a 16% alkylarylsulfonate, 40% of sodium triphosphate, 4% of fatty alcohol sulfate, 4% of sodium silicate, 2% of magnesium silicate and 3% of syndet soap comprising coconut acid ethanolamine (serves as test detergent)

for 15 minutes at 30° C. in a Linitest laboratory washing machine.

After the wash, the fabric is rinsed under running water.

b. Rinsing with the Formulation from Example 8

1000 g of the cotton fabric washed in a. are rinsed with 6 litres of water and 30 g of the rinse formulations 8a and 8b for 5 minutes at 30° C. in a washing machine and subsequently spun dry.

1 part of the fabric is ironed dry.

1 part of the fabric soiled with wine and coffee is exposed in the damp state to Osram lamps for 4 hours and subsequently ironed dry.

The fabric soiled with tea is exposed in the damp state using Osram lamps for 2 hours and subsequently ironed dry.

Furthermore, the rinsing and exposure process in the case of the fabric soiled with tea is repeated three times and five times (1, 3 or 5 cycles). The results are given in Table 5.

TABLE 5

Results of the washing test of the fabric soiled with red wine or coffee

| | fabric soiled with red wine Y(Start) = 52.3 | | | | fabric soiled with coffee Y(Start) = 73.7 | | | |
|---|---|---|---|---|---|---|---|---|
| | without exposure | | with exposure for 4 hours | | without exposure | | with exposure for 4 hours | |
| | Y | ΔY | Y | ΔY | Y | ΔY | Y | ΔY |
| Formulation 8a) | 66.1 | | 66.2 | | 77.9 | | 80.2 | |
| Formulation 8b) | 65.0 | 1.1 | 71.5 | 5.3 | 79.4 | 1.5 | 86.9 | 6.7 |

The results show that significantly higher brightness values are achieved with the novel fabric softener composition after exposure for 4 hours.

TABLE 6

Results of the washing test of the fabric soiled with tea

| | fabric soiled with tea Y(Start) = 35.5 | | | | | | | | | | | |
|---|---|---|---|---|---|---|---|---|---|---|---|---|
| | after 1 washing cycle | | | | after 3 washing cycles | | | | after 5 washing cycles | | | |
| | none | | 2 hours | | none | | 2 hours | | none | | 2 hours | |
| Exposure | Y | ΔY | Y | ΔY | Y | ΔY | Y | ΔY | Y | ΔY | Y | ΔY |
| Formulation 8a) | 40.6 | | 40.7 | | 41.2 | | 44.7 | | 41.3 | | 49.9 | |
| Formulation 8b) | 40.2 | −0.4 | 43.4 | 2.7 | 41.6 | 0.4 | 53.4 | 8.7 | 41.6 | 0.3 | 63.5 | 13.6 |

The results show that significantly higher brightness values are achieved using the novel fabric softener composition.

What is claimed is:

1. A rinse-added fabric softener composition comprising (a) a water-soluble phthalocyanine of Zn, Fe(II), Ca, Mg, Na, K, Al, Si(IV), P(V), Ti(IV), Ge(IV), Cr(VI), Ga(III), Zr(IV), In(III), Sn(IV) or Hf(VI); and (b) a quaternary ammonium compound of the formula (1)

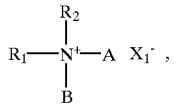

in which $R_1$ and $R_2$ independently of one another are $C_1$–$C_5$alkyl; or hydroxy-$C_1$–$C_5$alkyl;

A is the radical of the formula (1a)

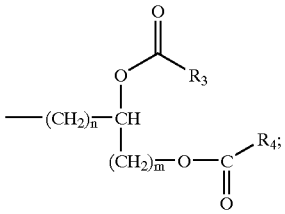

(1b)

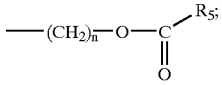

or the radical of the formula

B is $C_1$–$C_5$alkyl; a $C_8$–$C_{20}$ fatty acid radical; the radical of the formula (1a) or the radical of the formula (1b);

$R_3$, $R_4$ and $R_5$ independently of one another are a $C_8$–$C_{20}$ fatty acid radical;

$X_1^-$ is a softener-compatible anion; and m, n and p are numbers from 0 to 5.

2. A composition according to claim 1, which comprises a phthalocyanine of the formula (2a)

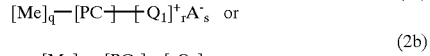

(2b)

in which

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, carboxylate, alkanolate, or hydroxyl ion;

q is 0, 1 or 2;

r is 1 to 4;

$Q_1$ is a sulfo or carboxyl group; or a radical of the formula

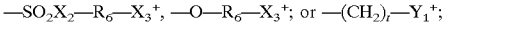

in which $R_6$ is a branched or unbranched $C_1$–$C_8$alkylene; or 1,3- or 1,4-phenylene;

$X_2$ is —NH—; or —N—$C_1$–$C_5$alkyl;

$X_3^+$ is a group of the formula

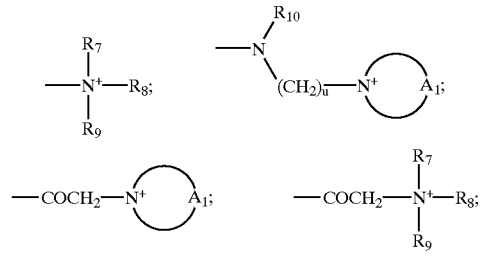

or, in the case where $R_6$=$C_1$–$C_8$alkylene, also a group of the formula

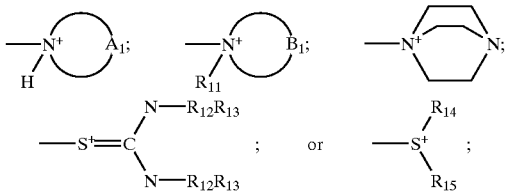

$Y_1^+$ is a group of the formula

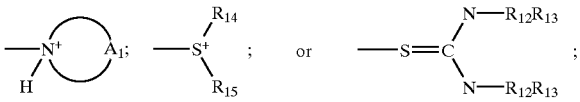

t is 0 or 1;

where in the above formulae $R_7$ and $R_8$ independently of one another are $C_1$–$C_6$alkyl;

$R_9$ is $C_1$–$C_6$alkyl; $C_5$–$C_7$cycloalkyl; or $NR_{11}R_{12}$;

$R_{10}$ and $R_{11}$ independently of one another are $C_1$–$C_5$alkyl;

$R_{12}$ and $R_{13}$ independently of one another are hydrogen or $C_1$–$C_5$alkyl;

$R_{14}$ and $R_{15}$ independently of one another are unsubstituted $C_1$–$C_6$alkyl or $C_1$–$C_6$alkyl substituted by hydroxyl, cyano, carboxyl, carb-$C_1$–$C_6$alkoxy, $C_1$–$C_6$alkoxy, phenyl, naphthyl or pyridyl;

u is from 1 to 6;

$A_1$ is a unit which completes an aromatic 5- to 7-membered nitrogen heterocycle, which may also contain one or two further nitrogen atoms as ring members, and $B_1$ is a unit which completes a saturated 5- to 7-membered nitrogen heterocycle, which may also contain 1 to 2 nitrogen, oxygen and/or sulfur atoms as ring members;

$Q_2$ is hydroxyl; $C_1$–$C_{22}$alkyl; branched $C_4$–$C_{22}$alkyl; $C_2$–$C_{22}$alkenyl; branched $C_4$–$C_{22}$alkenyl and mixtures thereof; $C_1$–$C_{22}$alkoxy; a sulfo or carboxyl radical; a radical of the formula

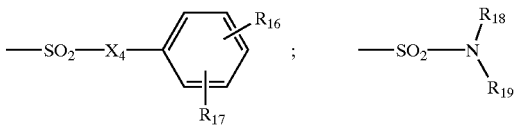

-continued

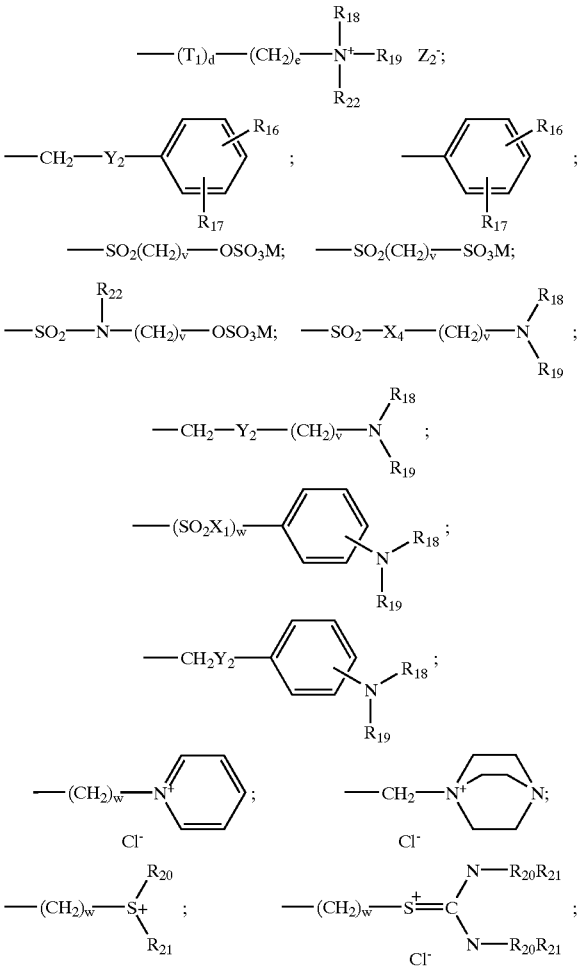

a branched alkoxy radical of the formula

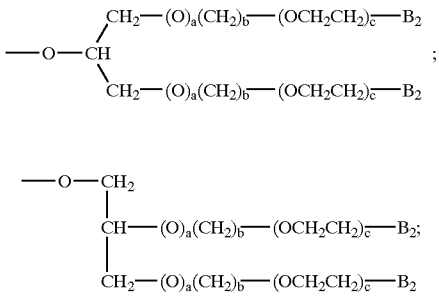

an alkylethyleneoxy unit of the formula $—(T_1)_d—(CH_2)_b(OCH_2CH_2)_a—B_3$ or an ester of the formula $COOR_{23}$ in which $B_2$ is hydrogen; hydroxyl; $C_1$–$C_{30}$alkyl; $C_1$–$C_{30}$alkoxy; $—CO_2H$; $—CH_2COOH$; $SO_3^-M_1^+$; $—OSO_3^-M_1^+$; $—PO_3^{2-}$; $M_1$; $—OPO_3^{2-}M_1$; and mixtures thereof;

$B_3$ is hydrogen; hydroxyl; —COOH; $—SO_3^-M_1^+$; $—OSO_3^-M_1^+$; $C_1$–$C_6$alkoxy;

$M_1$ is a water-soluble cation;

$T_1$ is —O—; or —NH—;

$X_1$ and $X_4$ independently of one another are —O—; —NH—; or $—N—C_1$–$C_5$alkyl;

$R_{16}$ and $R_{17}$ independently of one another are hydrogen, a sulfo group and salts thereof, a carboxyl group and salts thereof or a hydroxyl group, at least one of the radicals $R_{16}$ and $R_{17}$ being a sulfo or carboxyl group or salts thereof, $Y_2$ is —O—, —S—, —NH— or $—N—C_1$–$C_5$alkyl;

$R_{18}$ and $R_{19}$ independently of one another are hydrogen, $C_1$–$C_6$alkyl, hydroxy-$C_1$–$C_6$alkyl, cyano-$C_1$–$C_6$alkyl, sulfo-$C_1$–$C_6$alkyl, carboxyl or halogen-$C_1$–$C_6$alkyl; unsubstituted phenyl or phenyl substituted by halogen, $C_1$–$C_4$alkyl or $C_1$–$C_4$alkoxy, sulfo or carboxyl or $R_{18}$ and $R_{19}$ together with the nitrogen atom to which they are bonded are a saturated 5- or 6-membered heterocyclic ring which may additionally also contain a nitrogen or oxygen atom as a ring member;

$R_{20}$ and $R_{21}$ independently of one another are $C_1$–$C_6$alkyl or aryl-$C_1$–$C_6$alkyl radicals;

$R_{22}$ is hydrogen; or unsubstituted $C_1$–$C_6$alkyl or $C_1$–$C_6$alkyl substituted by halogen, hydroxyl, cyano, phenyl, carboxyl, carb-$C_1$–$C_6$alkoxy or $C_1$–$C_6$alkoxy;

$R_{23}$ is $C_1$–$C_{22}$alkyl, branched $C_4$–$C_{22}$alkyl, $C_1$–$C_{22}$alkenyl or branched $C_4$–$C_{22}$alkenyl; $C_3$–$C_{22}$glycol; $C_1$–$C_{22}$alkoxy; branched $C_4$–$C_{22}$alkoxy; and mixtures thereof;

M is hydrogen; or an alkali metal ion or ammonium ion, $Z_2$ is a chlorine, bromine, alkylsulfate or aralkylsulfate ion;

a is 0 or 1;

b is from 0 to 6;

c is from 0 to 100;

d is 0; or 1;

e is from 0 to 22;

v is an integer from 2 to 12;

w is 0 or 1; and

A is an organic or inorganic anion, and s is equal to r in cases of monovalent anions $A^-$ and is $\leqq r$ in cases of polyvalent anions; it being necessary for $A_s^-$ to compensate the positive charge; where, when $r \neq 1$, the radicals $Q_1$ can be identical or different, and where the phthalocyanine ring system may also comprise further solublising groups.

3. A composition according to claim 1, which comprises a phthalocyanine of the formula

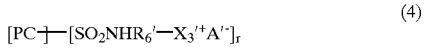

(4)

in which

PC is the phthalocyanine ring system $R_6'$ is $C_2$–$C_6$alkylene;

r is a number from 1 to 4;

$X_3'^+$ is a group of the formula

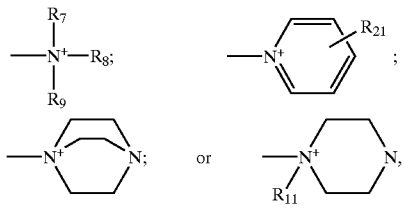

in which $R_7$ and $R_8$ independently of one another are unsubstituted $C_1$–$C_4$alkyl or $C_1$–$C_4$alkyl substituted by hydroxyl, cyano, halogen or phenyl;

$R_9$ is $R_7$; cyclohexyl or amino;

$R_{11}$ is $C_1$–$C_4$alkyl;

$R_{21}$ is $C_1$–$C_4$alkyl; $C_1$–$C_4$alkoxy; halogen, carboxyl, carb-$C_1$–$C_4$alkoxy or hydroxyl; and A' is a halide, alkylsulfate or arylsulfate ion;

it being possible for the radicals —$SO_2NHR'_6$—$X_3'^{+}A^-$ to be identical or different.

4. A composition according to claim 1, which comprises phthalocyanines of the formula $$[Me]_q—[PC]—[SO_3—Y_3']_r \quad (5)$$

in which

PC is the phthalocyanine ring system;

Me is Zn, Fe(II), Ca, Mg, Na, K, Al—$Z_1$, Si(IV), P(V), Ti(IV), Ge(IV), Cr(VI), Ga(III), Zr(IV), In(III), Sn(IV) or Hf(VI);

$Z_1$ is a halide, sulfate, nitrate, carboxylate, alkanolate, or hydroxyl ion;

q is 0; 1; or 2;

$Y_3'$ is hydrogen; an alkali metal ion or ammonium ion; and r is any number from 1 to 4.

5. A composition according to claim 4, wherein in formula (5)

Me is Zn or Al—$Z_1$; and $Z_1$ is a halide, sulfate, nitrate, carboxylate, alkanolate, or hydroxyl ion.

6. A composition according to claim 1, which comprises a phthalocyanine of the formula (10)

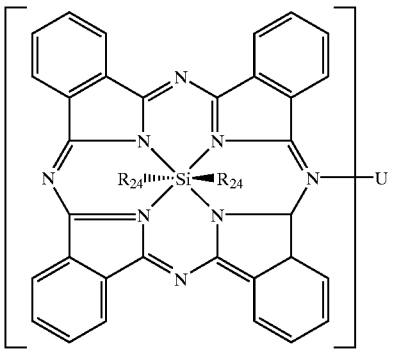

in which $R_{24}$ is hydroxyl; $C_1$–$C_{22}$alkyl; branched $C_4$–$C_{22}$alkyl; $C_1$–$C_{22}$alkenyl; branched $C_4$–$C_{22}$alkenyl and mixtures thereof; $C_1$–$C_{22}$alkoxy; a sulfo or carboxyl radical; a radical of the formula

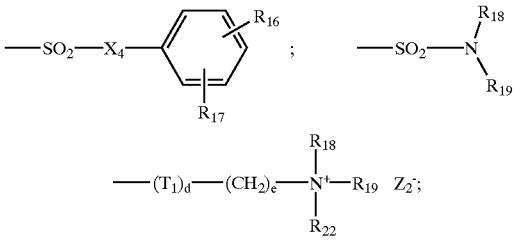

-continued

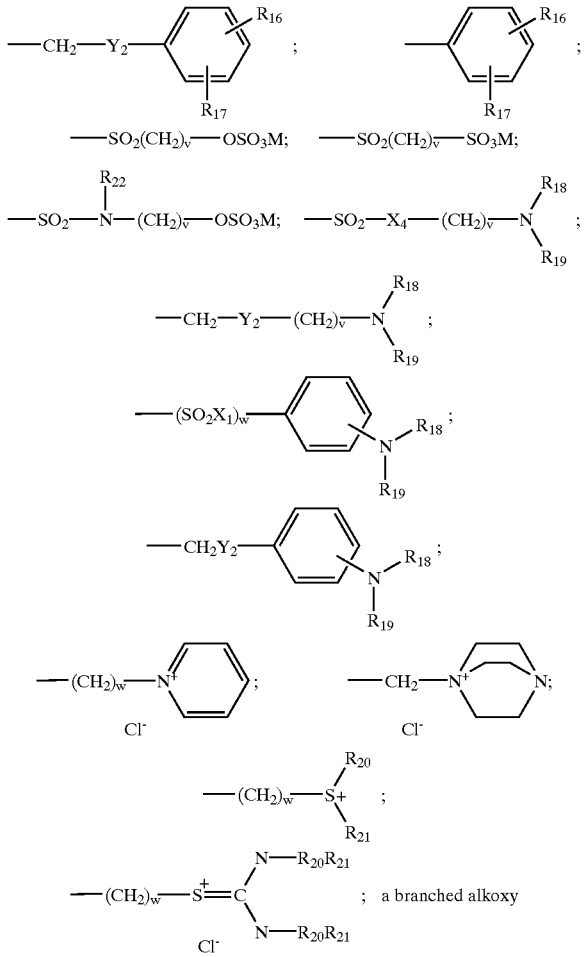

radical of the formula

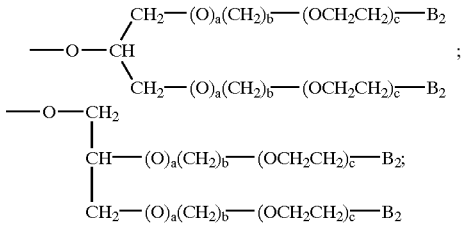

an alkylethyleneoxy unit of the formula —$(T_1)_d$—$(CH_2)_b(OCH_2CH_2)_a$—$B_3$ or an ester of the formula $COOR_{23}$; and U is $[Q_1]_r^+A_s^-$; or $Q_2$; and $R_{16}$, $R_{17}$, $R_{18}$, $R_{19}$, $R_{20}$, $R_{21}$, $R_{22}$, $R_{23}$, $B_2$, $B_3$, M, $M_1$, $Q_1$, $Q_2$, $A_s$, $T_1$, $X_1$, $Y_2$, $Z_2$, a, b, c, d, e, r, v, w are as defined in the formulae (2a) and (2b).

7. A composition according to claim 1, wherein the quaternary ammonium compound has the formula (1), in which $X_1$ is a halogen atom; —$CH_3SO_4^-$; —$C_2H_5SO_4^-$; or —$NO_3^-$.

8. A composition according to claim 1, wherein in formula (1) A and B independently of one another are the radical of the formula (1a) or (1b).

9. A composition according to claim 8, wherein A and B are the radical of the formula (1b).

10. A composition according to claim 1, wherein the quaternary ammonium compound has the formula (8)

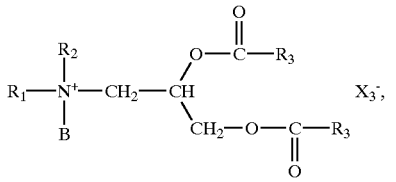

in which $R_1$, $R_2$ and B are $C_1$–$C_5$alkyl;

$R_3$ is the aliphatic radical of tallow fatty acid; and $X_3^-$ is a halogen atom.

11. A composition according to claim 1 comprising (a) a water-soluble phthalocyanine of the formula (5)

(b) a quaternary ammonium compound of the formula (8)

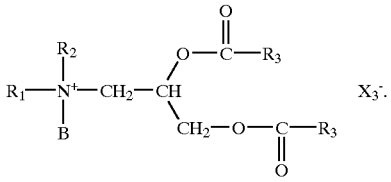

12. A composition according to claim 1 comprising (a) a water-soluble phthalocyanine of the formula (10)

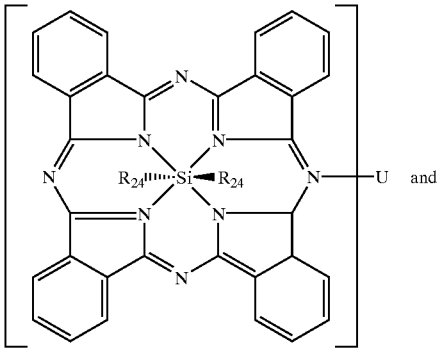

(b) a quaternary ammonium compound of the formula (8)

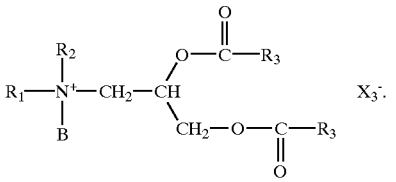

13. A composition according to claim 1, which comprises from 0.0001 to 0.05% by weight of component (a) and from 1 to 20% by weight of component (b).

14. A process for the bleaching of textile fibre materials using a photobleaching agent, which comprises treating soiled textiles, after washing in a bath of a rinse-added fabric softener composition comprising (a) a water-soluble phthalocyanine of Zn, Fe(II), Ca, Mg, Na, K, Al, Si(IV), P(V), Ti(IV), Ge(IV), Cr(VI), Ga(III), Zr(IV), In(III), Sn(IV) or Hf(VI) phthalocyanine; and (b) a quaternary ammonium compound of the formula (1) as defined in claim 1, with irradiation with visible and/or infrared light or daylight, either in the fabric softener bath directly or on the damp textiles outside the fabric softener bath, and in the presence of oxygen.

15. A composition according to claim 1 which comprises a phthalocyanine of the formula (3a)

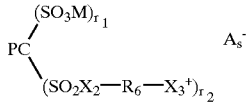

in which

PC is the phthalocyanine ring system;

$R_6$ is a branched or unbranched $C_1$–$C_8$alkylene; or 1,3- or 1,4-phenylene;

$X_2$ is —NH—; or —N—$C_1$–$C_5$alkyl;

$X_3^+$ is a group of the formula

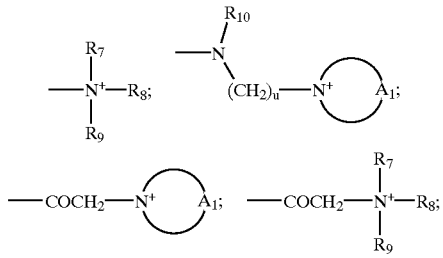

or, in the case where $R_6$=$C_1$–$C_8$alkylene, also a group of the formula

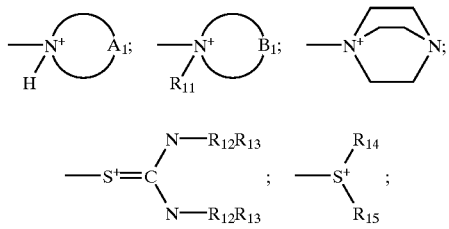

M is hydrogen, an alkali metal ion, ammonium ion or amine salt ion;

and the sum of the numbers $r_1$ and $r_2$ is from 1 to 4 and $A_s$ balances exactly the positive charge on the remainder of the molecule.

* * * * *